US008373719B2

(12) United States Patent
Chen

(10) Patent No.: US 8,373,719 B2
(45) Date of Patent: Feb. 12, 2013

(54) CONTROL METHOD FOR IMPROVING LUMINOUS UNIFORMITY AND RELATED LUMINOSITY CALIBRATING CONTROLLER AND DISPLAY DEVICE

(75) Inventor: Hsing-Chuan Chen, Taichung (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 611 days.

(21) Appl. No.: 12/629,874

(22) Filed: Dec. 2, 2009

(65) Prior Publication Data

US 2011/0037774 A1 Feb. 17, 2011

(30) Foreign Application Priority Data

Aug. 13, 2009 (TW) ..... 98127245 A

(51) Int. Cl.
*G09G 5/02* (2006.01)

(52) U.S. Cl. ..... 345/589

(58) Field of Classification Search ..... 345/589–605
See application file for complete search history.

(56) References Cited

U.S. PATENT DOCUMENTS

| | | | | |
|---|---|---|---|---|
| 5,021,881 | A * | 6/1991 | Avis et al. | 348/451 |
| 5,268,758 | A * | 12/1993 | Nakayama et al. | 348/628 |
| 5,343,254 | A * | 8/1994 | Wada et al. | 348/627 |
| 5,528,741 | A * | 6/1996 | Lucas | 345/593 |
| 7,768,567 | B2 * | 8/2010 | Azuma | 348/335 |
| 7,868,857 | B2 * | 1/2011 | Nathan et al. | 345/82 |
| 2001/0015835 | A1 * | 8/2001 | Aoki | 358/525 |
| 2005/0001936 | A1 * | 1/2005 | Mao | 348/675 |

FOREIGN PATENT DOCUMENTS

| | | | |
|---|---|---|---|
| CN | 1753061 | A | 3/2006 |
| JP | H0667620 | A | 3/1994 |
| JP | H10341451 | A | 12/1998 |
| JP | H11109927 | A | 4/1999 |
| JP | 2001343955 | A | 12/2001 |
| JP | 200346809 | A | 2/2003 |
| JP | 2006119585 | A | 5/2006 |
| JP | 2006330312 | A | 12/2006 |
| JP | 200786678 | A | 4/2007 |

* cited by examiner

*Primary Examiner* — Xiao M. Wu
*Assistant Examiner* — Charles Tseng
(74) *Attorney, Agent, or Firm* — Winston Hsu; Scott Margo

(57) ABSTRACT

A control method for improving the luminous uniformity of a display device includes a panel which includes a plurality of sampling pixels, wherein each sampling pixel corresponding to a coordinate of the panel. The control method includes receiving an input pixel, determining the neighboring pixels of the input pixel according to a coordinate of the input pixel and the coordinates of the plurality of the sampling pixels, receiving the gamma table of the neighboring sampling pixels, each gamma table including a luminous calibrating value of a neighboring sampling pixel, retrieving the corresponding specific luminous calibrating value according to the corresponding grey level of the input pixel, and calculating the luminous calibrating value of the input pixel according to the coordinate of the input pixel, the coordinates of the neighboring sampling pixels and the specific luminous calibrating value.

16 Claims, 4 Drawing Sheets

CONTROL METHOD FOR IMPROVING LUMINOUS UNIFORMITY AND RELATED LUMINOSITY CALIBRATING CONTROLLER AND DISPLAY DEVICE

BACKGROUND OF THE INVENTION

1. Field of the Invention

The present invention is related to a control method for improving luminous uniformity of a display device, and the related luminosity calibrating controller and display device, and more particularly, to a control method which can utilize a small number of gamma tables to improve the luminous uniformity of the entire pixels, and the related luminosity calibrating controller and display device.

2. Description of the Prior Art

As the video display technology advances, consumers kept asking for even higher quality of display device. In general, there are several aspects to judge the quality of a display device; for example, a good display device has to be highly stable and reliable, and the picture displayed should be of good quality. To improve the quality of the picture, the display device should have higher resolution and can display good color, and the luminosity of the displayed images must be uniform. Taking the LCD device as an example, because the luminosity distribution of the LCD backlight is not perfect, and also the driving voltages and the liquid crystal characteristics of the different pixels may present certain differences, such that the LCD device cannot have good luminous uniformity, and some calibrating method is required to achieve luminous uniformity. Considering the viewpoint of an ordinary consumer, and let the consumer to observe an image of the same gray level, and the image is displayed by a LCD device without applying any luminosity calibration, then he/she is likely to find that different areas on the display device may present very different luminosity for the image data of same gray level. On the other hand, if a fine luminosity meter is applied to measure the displayed image of same gray level, then it can be found that different pixels may read out different luminous value, and the difference can be large. Usually, by comparing the luminous values in the central part and the boundary part of the displayed image, an obvious difference in luminosity can be observed. Under this condition, in order to make the luminosity more uniform, a proprietary circuit for luminosity calibration must be built in the display device, and a strict luminous calibration procedure must be applied in the production process of the display device. After the calibration process is done in the manufacturing process, the display device can perform the luminosity calibration (or called luminosity compensation) to the input image data, while operating in the normal mode, such that the displayed images are of good luminous uniformity, and the display device can be qualified as a high quality display device.

The objective of the luminosity calibration is to make any two pixels of the display device to display the same luminous value for the same gray level of image data. For various reasons, like those stated above, any two pixels of a display device without doing a luminosity calibration are unlikely to display the same luminous value for the same gray level. To improve the luminous uniformity, a luminosity calibration procedure is thus required. The method of luminosity calibration is to adjust the input gray level of the image data to produce a new gray level, such that the displayed luminosity is as close as possible for the same input gray level. And, the difference between the new gray level and the original input gray level is called the luminosity calibrating value δE. In general, since the number of pixels in the display device is enormously large, a pixel-by-pixel luminosity calibration process will take vast amount of time, and it will take hours or even tens of hours to complete the calibration process for only a display device, such that the cost is high. Meanwhile, after completing the luminosity calibration, the display device must include a memory device to store the calibrating value δE for the entire gray levels of every pixel, thus a large memory space is required in the circuit, and sometimes needs an external dynamic RAM (DRAM) to store all the calibrating values.

SUMMARY OF THE INVENTION

Therefore, the main objective of the present invention is to provide a control method for improving the luminous uniformity of a display device, and the related luminosity calibrating controller and display device.

The present invention discloses a control method which improves luminous uniformity of a display device, equipped with a panel comprising a plurality of sampling pixels each corresponding to a coordinate of the panel, the control method comprising receiving an input pixel; determining a plurality of neighboring pixels of the input pixel according to a coordinate of the input pixel and coordinates of the plurality of sampling pixels; receiving a plurality of gamma tables of the plurality of neighboring sampling pixels, each gamma table comprising a plurality of luminous calibrating values of a neighboring sampling pixel; acquiring a specific luminous calibrating value corresponding to a gray level of the input pixel from each of the plurality of gamma tables, according to the gray level of the input pixel; and calculating a luminous calibrating value of the input pixel according to the coordinate of the input pixel, the coordinates of the plurality of neighboring sampling pixels and a plurality of specific luminous calibrating values.

The present invention further discloses a luminosity calibrating controller which improves luminous uniformity of a display device, equipped with a panel comprising a plurality of sampling pixels each corresponding to a coordinate of the panel, the luminosity calibrating controller comprising a receiving end, for receiving an input pixel; a neighboring sampling pixel estimation unit, for determining a plurality of neighboring pixels of the input pixel according to a coordinate of the input pixel and coordinates of the plurality of sampling pixels; a look-up table accessing unit, for receiving a plurality of gamma tables of the plurality of neighboring sampling pixels, each gamma table comprising a plurality of luminous calibrating values of a neighboring sampling pixel; a calibrating value accessing unit, for acquiring a specific luminous calibrating value corresponding to a gray level of the input pixel from each of the plurality of gamma tables, according to the gray level corresponding to the input pixel; and a compensation calculating unit, for calculating a luminous calibrating value of the input pixel according to the coordinate of the input pixel, the coordinates of the plurality of neighboring sampling pixels and a plurality of specific luminous calibrating values.

The present invention further discloses A display device, capable of improving luminous uniformity, comprising a panel, comprising a plurality of sampling pixels each corresponding to a coordinate of the panel; an image receiving unit, for receiving a plurality of input pixels; and a luminosity calibrating controller, comprising a neighboring sampling pixel estimation unit, for determining a plurality of neighboring pixels of an input pixel according to a coordinate of the input pixel and coordinates of the plurality of sampling pixels; a look-up table accessing unit, for receiving a plurality of gamma tables of the plurality of neighboring sampling pixels, each gamma table comprising a plurality of luminous calibrating values of a neighboring sampling pixel; a calibrating value accessing unit, for acquiring a specific luminous calibrating value corresponding to a gray level of the input pixel from each of the plurality of gamma tables, according to the gray level of the input pixel; and a compensation calculating unit, for calculating a luminous calibrating value of the input pixel according to the coordinate of the input pixel, the coordinates of the plurality of neighboring sampling pixels and a plurality of specific luminous calibrating values.

These and other objectives of the present invention will no doubt become obvious to those of ordinary skill in the art after reading the following detailed description of the preferred embodiment that is illustrated in the various figures and drawings.

DETAILED DESCRIPTION

For decreasing the length of time required for the luminosity calibration of the display device, a luminosity calibration method has been disclosed in Taiwan Patent Application No. 098125483, which applies a mathematical transfer function to transfer the measured data of the luminosity and the gray level, from the exponential-like relationship to a much simpler form of linear relationship. Then, a linear interpolation method is applied to derive the relation between the luminosity and the gray level of the rest of the gray levels for each of the sampling pixels without doing real measurement, and establish a proprietary linear calibrating function for each of the sampling pixels. Next, to compare the linear calibrating function of the sampling pixels with the linear calibrating function of a reference pixel, the differential values between the input gray level and the adjusted gray level can be estimated for every sampling pixel, and the estimated differential values are called the luminosity calibrating value E; based on that, the Gamma tables for the sampling pixels can be calculated and derived. Because the number of sampling pixels is much less than the total number of pixels in the screen (in general, the total number of pixels is in the order of several hundreds of thousand to several million, and the number of sampling pixels is in the order of several hundred to several thousand), the calibration time of the display device can be decreased with a great amount. However, after the calibration has completed, and the display device is operated in the normal mode, the luminosity calibration is needed for the entire pixels (including the sampling pixels); therefore, the main objective of the present invention is to disclose how to utilize only the Gamma tables of the sampling pixels to perform luminosity calibration to the entire pixels.

Figure 1:
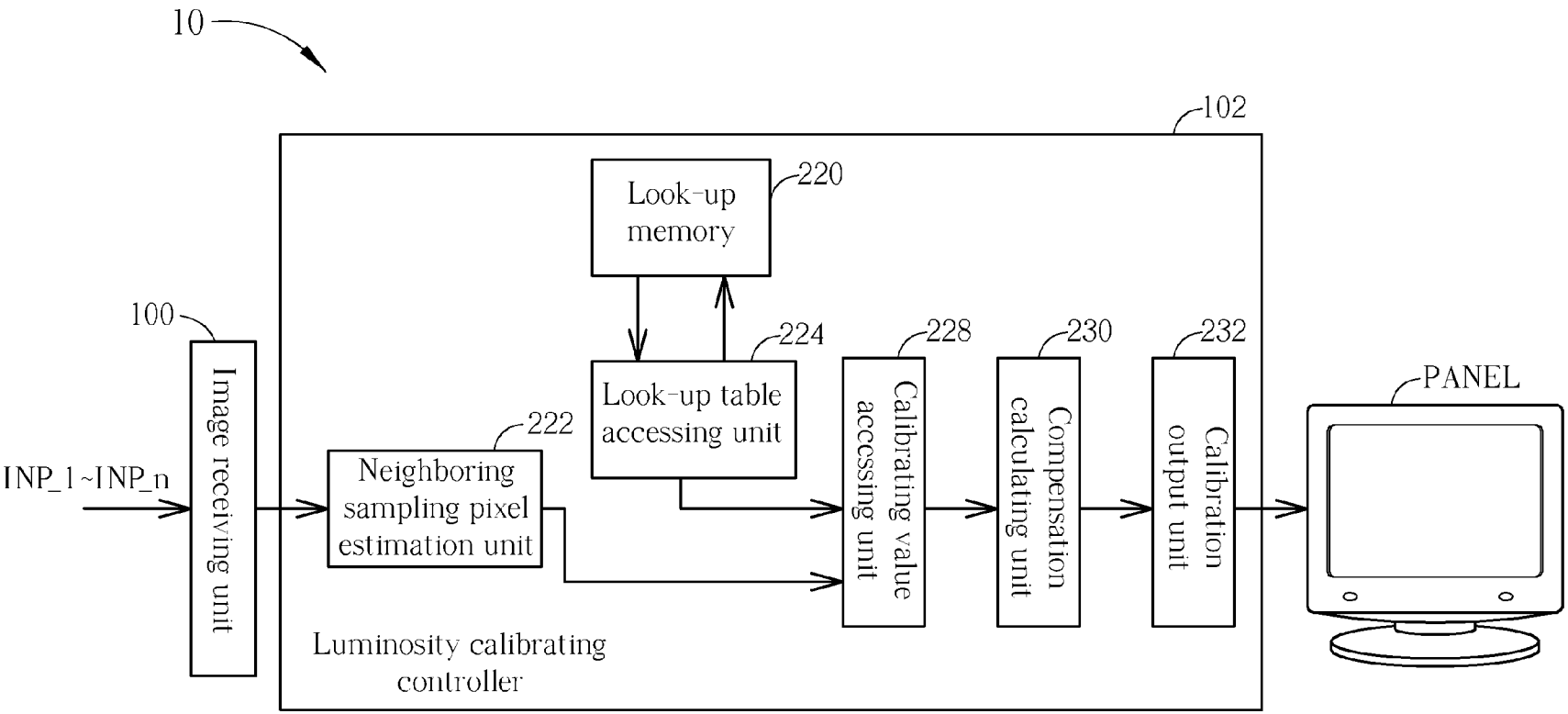
FIG. 1 illustrates a schematic diagram of a display device 10 with luminosity calibration function according to an embodiment of the present invention.

Please refer to FIG. 1, which illustrates a schematic diagram of a display device 10 with luminosity calibration function according to an embodiment of the present invention. The display device 10 comprises a panel PANEL, an image receiving unit 100 and a luminosity calibrating controller 102. The panel PANEL comprises a great number of display elements arranged as a matrix, and part of the display elements are defined as sampling pixels SP_1~SP_M. The image receiving unit 100 is utilized to receive input pixels INP_1~INP_n, corresponding to the display elements of the panel PANEL, according to the gray level data extracted from an external image data stream. The luminosity calibrating controller 102 is utilized to execute luminosity calibration to all the received input pixels INP_1~INP_n, and comprises a look-up memory 220, a neighboring sampling pixel estimation unit 222, a look-up table accessing unit 224, a calibrating value accessing unit 228, a compensation calculating unit 230 and a calibration output unit 232. The look-up memory 220 is utilized to store the Gamma tables GAT_1~GAT_M corresponding to the sampling pixels SP_1~SP_M, and each Gamma table GAT_x comprises a plurality of luminosity calibrating value corresponding to a sampling pixel SP_x, and the contents of the Gamma tables GAT_1~GAT_M are preferably established according to the method disclosed in Taiwan Patent Application No. 098125483, but is not limited to so. The neighboring sampling pixel estimation unit 222 is utilized to select (by estimation) the sampling pixels SP_a, SP_b, SP_c and SP_d, which are adjacent to an input pixel INP_i, from the sampling pixels SP_1~SP_M, according to the coordinate of the input pixel INP_i and the coordinates of the sampling pixels SP_1~SP_M. The look-up table accessing unit 224 is utilized to read the Gamma tables GAT_a, GAT_b, GAT_c and GAT_d, which correspond to the sampling pixels SP_a, SP_b, SP_c and SP_d. The calibrating value accessing unit 228 is utilized to find the luminosity calibrating values E_a, E_b, E_c and E_d corresponding to a gray level GL_i from the Gamma tables GAT_a, GAT_b, GAT_c and GAT_d, according to an input pixel INP_i, which corresponds to the gray level GL_i. The compensation calculating unit 230 calculates the luminosity calibrating value E_i of the input pixel INP_i, according to the coordinates of the input pixel INP_i and the sampling pixels SP_a, SP_b, SP_c and SP_d, and the luminosity calibrating values E_a, E_b, E_c and E_d. At last, the calibration output unit 232 calculates the summation of the gray level GL_i and the luminosity calibrating value E_i, and output the result to the panel PANEL.

In brief, after the image receiving unit 100 receives the input pixel INP_i, the neighboring sampling pixel estimation unit 222 determines first those sampling pixels SP_a, SP_b, SP_c and SP_d, which are adjacent to the input pixel INP_i, such that the look-up table accessing unit 224 can select and input the corresponding Gamma tables GAT_a, GAT_b, GAT_c and GAT_d. The calibrating value accessing unit 228 then finds the luminosity calibrating values δE_a, δE_b, δE_c and δE_d, which correspond to the gray level GL_i, from the Gamma tables GAT_a, GAT_b, GAT_c and GAT_d. The compensation calculating unit 230 calculates the luminosity calibrating value δE_i of the input pixel INP_i, according to the coordinates of the input pixel INP_i and the sampling pixels SP_a, SP_b, SP_c and SP_d, and the luminosity calibrating values δE_a, δE_b, δE_c and δE_d, and outputs the calibrating result (GL_i+δE_i) to the panel PANEL via the calibration output unit 232. In other words, the luminosity calibrating controller 102 is utilized to determine the luminosity calibrating value δE_i of the input pixel INP_i, according to the input pixel INP_i and the Gamma tables GAT_a~GAT_d of its neighboring sampling pixels SP_a~SP_d. Therefore, to perform the luminosity calibration to every incoming pixel, only part of the pixels in the panel PANEL, which are the sampling pixels SP_1~SP_M, are required to keep their Gamma tables in the look-up memory 220.

Figure 2A:
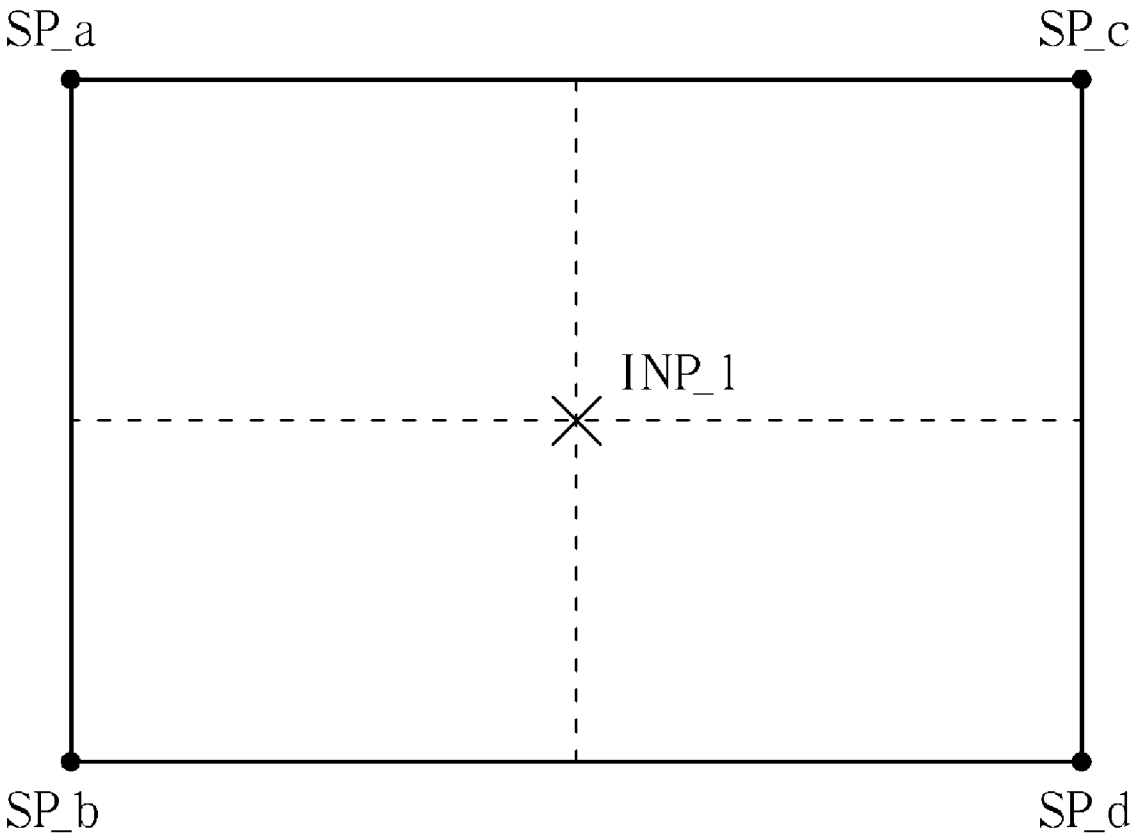
FIGS. 2A and 2B illustrate schematic diagrams of the geometrical relations between an input pixel and four neighboring sampling pixels.
Figure 2B:
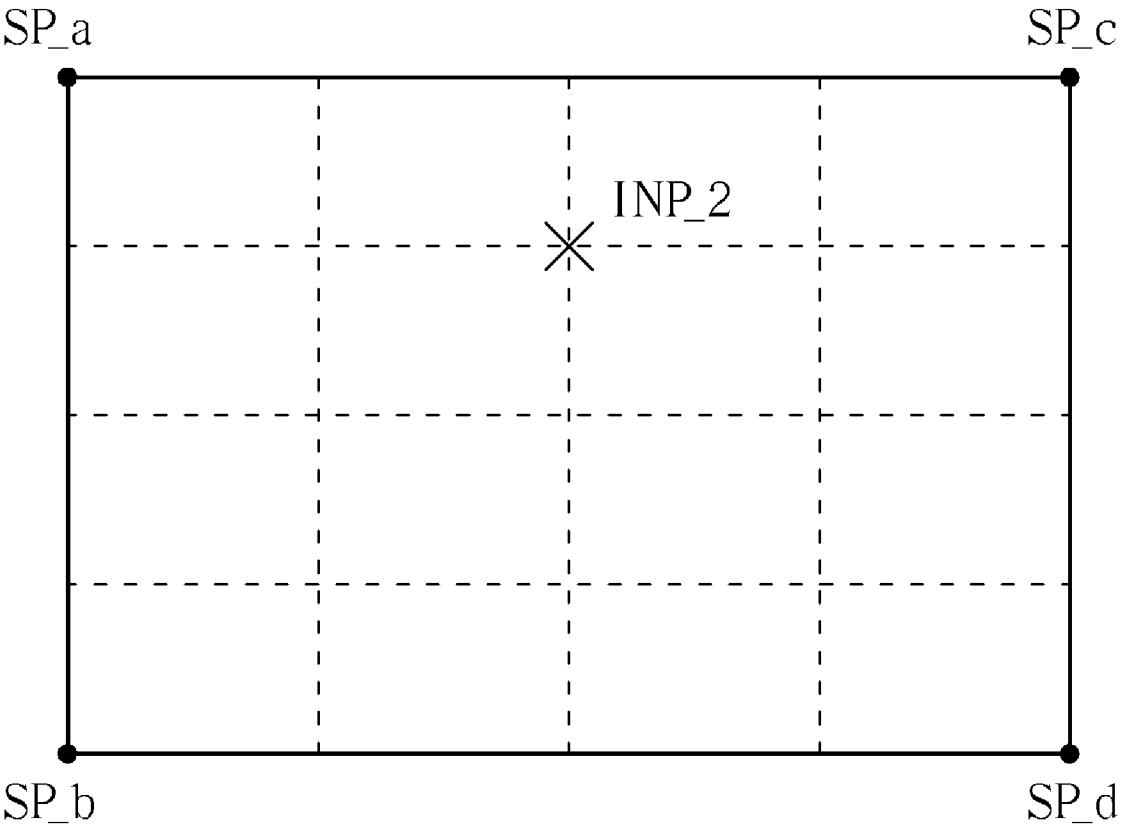

Noteworthily, the display device 10 depicted in FIG. 1 is an embodiment of the present invention, and those skilled in the art should readily observe that numerous alterations can be made, and not limited to this. For example, the number of neighboring sampling pixels SP_a~SP_d of the input pixel INP_i is not limited to 4, and can be other amounts, like 8 or 12. Besides, the compensation calculating unit 230 calculates the luminosity calibrating value δE_i of the input pixel INP_i is preferably in a way of weighted sum; that is to say, by taking the coordinates of the input pixel INP_i and the sampling pixels SP_a~SP_d, to determine the distance between the input pixel INP_i and each of the sampling pixels SP_a~SP_d, and then taking the distances as the weighted values to multiply with the luminosity calibrating values δE_a, δE_b, δE_c and δE_d, such that the luminosity calibrating value δE_i can be calculated. In other words, as the distance between the input pixel INP_i and any of the neighboring sampling pixels becomes larger, the contribution of the luminosity calibrating value of that neighboring sampling pixel will become smaller; on the contrary, if the distance becomes smaller, the corresponding weighted value will become larger. For example, please refer to FIGS. 2A and 2B, which illustrate two schematic diagrams of the geometrical relations between the input pixels INP_1, INP_2 and the sampling pixels SP_a~SP_d. Inside FIG. 2A, the input pixel is right on the equidistance point of the four neighboring sampling pixels SP_a~SP_d, and in this case, the luminosity calibrating values δE_a~δE_d corresponding to the sampling pixels SP_a~SP_d are determined to be 0.25. On the other hand, as depicted in FIG. 2B, the input pixel INP_1 is located closer to the sampling point SP_a, and according to the distance depicted in FIG. 2, the luminosity calibrating values δE_a~δE_d corresponding to the sampling pixels SP_a~SP_d are determined to be 0.375, 0.125, 0.25 and 0.25, respectively.

Besides that, as depicted in FIG. 1, the look-up table accessing unit 224 is utilized to access the Gamma tables stored in the look-up memory 220, and according to different system specification and amounts of data, the design of the look-up memory 220 can have other options. For example, if the data quantity corresponding to the Gamma tables GAT_1~GAT_M is relatively small, then the look-up memory 220 can be realized by a flash memory built in the integrated circuit. On the contrary, if the data quantity corresponding to the Gamma tables GAT_1~GAT_M is large, then the look-up memory 220 can be realized by an external dynamic random-access-memory (DRAM). Also, a static random-access-memory (SRAM) can be inserted between the look-up table accessing unit 224 and the calibrating value accessing unit 228, to function as a cache memory and increase the data access speed. For example, if the data quantity of the Gamma tables GAT_1~GAT_M is relatively small, then the loop-up accessing unit 224 can transfer the whole Gamma tables GAT_1~GAT_M (including the Gamma tables GAT_a~GAT_d) stored in the look-up memory 220 to the cache memory in the bootstrap stage. On the contrary, if the data quantity of the Gamma tables GAT_1~GAT_M and the required memory space is large, then the cache memory can be utilized to store part of the look up table (including the Gamma tables GAT_a~GAT_d) read by the look-up table accessing unit 224. Noteworthily, the memory organization and the associated data movement method are to describe some feasible access methods and interfaces for the luminosity calibrating controller 102, as long as the method is compliant with the main objective of the present invention, people with ordinary skill in the art can readily make numerous alterations according to different system requirements.

The major concept of the present invention is to estimate the luminosity calibrating value of the input pixel of a gray level, according to the luminosity calibrating values of the corresponding gray level selected from the Gamma tables of the neighboring sampling pixels of the input pixel. By doing so, by utilizing the Gamma tables of a portion of the pixels (sampling pixels), the luminosity calibration can be executed for all the pixels.

Figure 3:
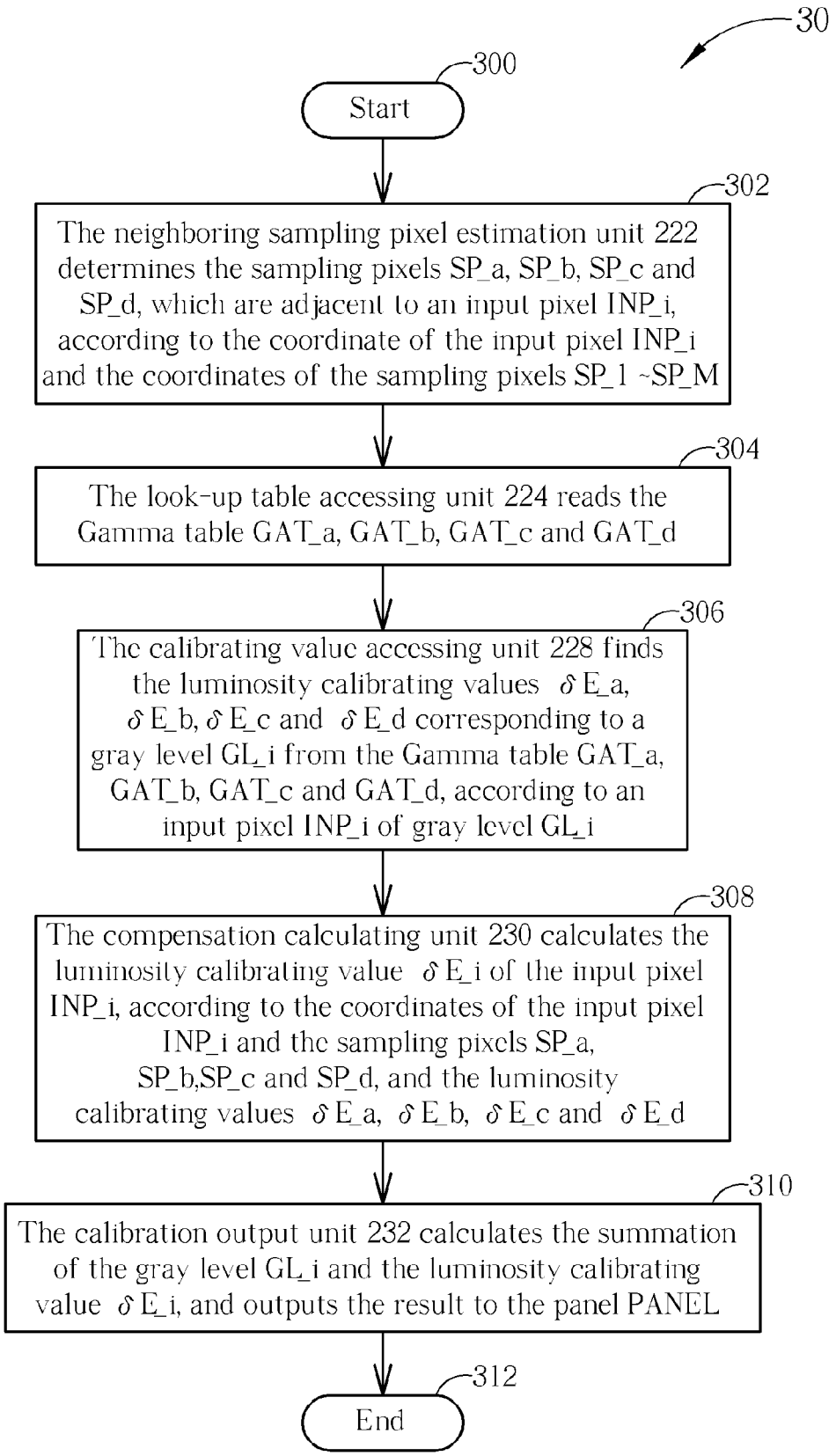
FIG. 3 illustrates a schematics diagram a control process utilized to improve the luminous uniformity of a display device according to an embodiment of the present invention.

According to the operating methods of the display device 10, a control process 30 can be derived and shown in FIG. 3. The control process 30 comprises the following steps:

STEP 300: Start.

STEP 302: The neighboring sampling pixel estimation unit 222 determines the sampling pixels SP_a, SP_b, SP_c and SP_d, which are adjacent to an input pixel INP_i, according to the coordinate of the input pixel INP_i and the coordinates of the sampling pixels SP_1~SP_M.

STEP 304: The look-up table accessing unit 224 reads the Gamma table GAT_a, GAT_b, GAT_c and GAT_d.

STEP 306: The calibrating value accessing unit 228 finds the luminosity calibrating values δE_a, δE_b, δE_c and δE_d corresponding to a gray level GL_i from the Gamma table GAT_a, GAT_b, GAT_c and GAT_d, according to an input pixel INP_i of gray level GL_i.

STEP 308: The compensation calculating unit 230 calculates the luminosity calibrating value δE_i of the input pixel INP_i, according to the coordinates of the input pixel INP_i and the sampling pixels SP_a, SP_b, SP_c and SP_d, and the luminosity calibrating values δE_a, δE_b, δE_c and δE_d.

STEP 310: The calibration output unit 232 calculates the summation of the gray level GL_i and the luminosity calibrating value δE_i, and outputs the result to the panel PANEL.

STEP 312: End.

The operating details of control process 30 can be referred to the descriptions above, and will not be detailed further.

The present invention utilizes the Gamma tables of the sampling pixels to calculate and derive the Gamma tables of the other pixels, such that every input pixel can get its luminosity calibrated. The present invention can also be applied to execute the luminosity calibration of an image signal comprising only one single color, and the result is proved equally well.

To sum up, to utilize limited number of the Gamma tables, the present invention is able to perform luminosity calibration to all the pixels in the display screen, not only the luminous uniformity can be increased such that the requirements of a high picture quality display device can be achieved, but also the size of memory space can be greatly decreased, and the cost is reduced.

Those skilled in the art will readily observe that numerous modifications and alterations of the device and method may be made while retaining the teachings of the invention.

What is claimed is:

1. A luminosity calibrating controller for improving luminous uniformity of a display device, equipped with a panel comprising a plurality of sampling pixels each corresponding to a coordinate of the panel, the luminosity calibrating controller comprising:

a receiving end, for receiving an input pixel;

a neighboring sampling pixel estimation unit, for determining a plurality of neighboring pixels of the input pixel according to a coordinate of the input pixel and coordinates of the plurality of sampling pixels;

a look-up table accessing unit, for receiving a plurality of gamma tables of the plurality of neighboring sampling pixels, each gamma table comprising a plurality of luminous calibrating values of a neighboring sampling pixel;

a calibrating value accessing unit, for acquiring a specific luminous calibrating value corresponding to a gray level of the input pixel from each of the plurality of gamma tables, according to the gray level corresponding to the input pixel; and a compensation calculating unit, for calculating a luminous calibrating value of the input pixel according to the coordinate of the input pixel, the coordinates of the plurality of neighboring sampling pixels and a plurality of specific luminous calibrating values;

wherein the plurality of gamma tables are derived by:

applying a mathematical transfer function to transfer measured data of luminosity and gray level of each of the plurality of sampling pixels, from exponential-like relationship to linear relationship;

applying a linear interpolation method to derive relation between unmeasured luminosity and gray level of each of the plurality of sampling pixels, to obtain linear calibrating function of each of the plurality of sampling pixels; and deriving each of the plurality of gamma tables according to the linear calibrating function of each of the plurality of sampling pixels.

2. The luminosity calibrating controller of claim 1 further comprising a look-up memory, for storing the gamma tables of the plurality of sampling pixels.

3. The luminosity calibrating controller of claim 2, wherein the look-up table accessing unit is utilized for accessing the look-up memory to acquire the plurality of gamma tables of the plurality of neighboring sampling pixels.

4. The luminosity calibrating controller of claim 1, wherein the look-up memory is a dynamic random access memory (DRAM).

5. The luminosity calibrating controller of claim 1 further comprising a cache memory, coupled between the look-up table accessing unit and the calibrating value accessing unit, for temporarily storing the plurality of gamma tables of the plurality of neighboring sampling pixels.

6. The luminosity calibrating controller of claim 1, wherein the look-up memory is a static random access memory (SRAM).

7. The luminosity calibrating controller of claim 1, wherein the compensation calculating unit is utilized for calculating a plurality of distances between the input pixel and the plurality of neighboring sampling pixels, according to the coordinate of the input pixel, the coordinates of the plurality of neighboring sampling pixels, and using a weighted sum method to calculate a plurality of weighting values of the luminosity calibrating value of the input pixel, corresponding to the plurality of specific calibrating values, according to the plurality of distances.

8. The luminosity calibrating controller of claim 1 further comprising a calibration output unit, coupled between the compensation calculating unit and the panel, for calculating a summation of the gray level of the input pixel and the luminosity calibrating value of the input pixel, and displaying the input pixel by outputting the calculating result to the panel.

9. A display device, capable of improving luminous uniformity, comprising:

a panel, comprising a plurality of sampling pixels each corresponding to a coordinate of the panel;

an image receiving unit, for receiving a plurality of input pixels; and a luminosity calibrating controller, comprising:

a neighboring sampling pixel estimation unit, for determining a plurality of neighboring pixels of an input pixel according to a coordinate of the input pixel and coordinates of the plurality of sampling pixels;

a look-up table accessing unit, for receiving a plurality of gamma tables of the plurality of neighboring sampling pixels, each gamma table comprising a plurality of luminous calibrating values of a neighboring sampling pixel;

a calibrating value accessing unit, for acquiring a specific luminous calibrating value corresponding to a gray level of the input pixel from each of the plurality of gamma tables, according to the gray level of the input pixel; and a compensation calculating unit, for calculating a luminous calibrating value of the input pixel according to the coordinate of the input pixel, the coordinates of the plurality of neighboring sampling pixels and a plurality of specific luminous calibrating values;

wherein the plurality of gamma tables are derived by:

applying a mathematical transfer function to transfer measured data of luminosity and gray level of each of the plurality of sampling pixels, from exponential-like relationship to linear relationship;

applying a linear interpolation method to derive relation between unmeasured luminosity and gray level of each of the plurality of sampling pixels, to obtain linear calibrating function of each of the plurality of sampling pixels; and deriving each of the plurality of gamma tables according to the linear calibrating function of each of the plurality of sampling pixels.

10. The display device of claim 9 further comprising a look-up memory, for storing the gamma tables of the plurality of sampling pixels.

11. The display device of claim 10, wherein the look-up table accessing unit is utilized for accessing the look-up memory to acquire the plurality of gamma tables of the plurality of neighboring sampling pixels.

12. The display device of claim 11, wherein the look-up memory is a dynamic random access memory (DRAM).

13. The display device of claim 9 further comprising a cache memory, coupled between the look-up table accessing unit and the calibrating value accessing unit, for temporarily storing the plurality of gamma tables of the plurality of neighboring sampling pixels.

14. The display device of claim 13, wherein the look-up memory is a static random access memory (SRAM).

15. The display device of claim 9, wherein the compensation calculating unit is utilized for calculating a plurality of distances between the input pixel and the plurality of neighboring sampling pixels, according to the coordinate of the input pixel, the coordinates of the plurality of neighboring sampling pixels, and using a weighted sum method to calculate a plurality of weighting values of the luminosity calibrating value of the input pixel, corresponding to the plurality of specific calibrating values, according to the plurality of distances.

16. The display device of claim 9 further comprising a calibration output unit, coupled between the compensation calculating unit and the panel, for calculating a summation of the gray level of the input pixel and the luminosity calibrating value of the input pixel, and displaying the input pixel by outputting the calculating result to the panel.

* * * * *